US010876261B2

(12) United States Patent
Wilkens et al.

(10) Patent No.: US 10,876,261 B2
(45) Date of Patent: Dec. 29, 2020

(54) THERMOPLASTIC PAINT MARKING SYSTEM AND METHOD

(71) Applicants: EPIC Solutions, Inc., Fargo, ND (US); Mark Rite Lines Equipment Co., Inc., Billings, MT (US)

(72) Inventors: Jeffrey Arnold Wilkens, West Fargo, ND (US); Timothy John Marthe, Rieles Acres, ND (US); Jonathan Robert Gonitzke, Joliet, MT (US); James Peter Spielman, Billings, MT (US)

( * ) Notice: Subject to any disclaimer, the term of this patent is extended or adjusted under 35 U.S.C. 154(b) by 52 days.

(21) Appl. No.: 15/894,578

(22) Filed: Feb. 12, 2018

(65) Prior Publication Data

US 2018/0230658 A1 Aug. 16, 2018

Related U.S. Application Data

(60) Provisional application No. 62/457,860, filed on Feb. 11, 2017.

(51) Int. Cl.

| | |
|---|---|
| ***E01C 23/22*** | (2006.01) |
| ***B05B 1/24*** | (2006.01) |
| ***B05B 12/00*** | (2018.01) |
| ***B05B 12/14*** | (2006.01) |
| ***B05B 9/00*** | (2006.01) |
| ***B05C 11/10*** | (2006.01) |
| ***B05B 13/00*** | (2006.01) |
| ***E01C 23/20*** | (2006.01) |

(Continued)

(52) U.S. Cl.

CPC ..... *E01C 23/22* (2013.01); *B05B 1/24* (2013.01); *B05B 9/002* (2013.01); *B05B 9/0423* (2013.01); *B05B 12/006* (2013.01); *B05B 12/081* (2013.01); *B05B 12/14* (2013.01); *B05B 13/005* (2013.01); *B05C 11/1042* (2013.01); *E01C 23/206* (2013.01); *B05C 11/101* (2013.01)

(58) Field of Classification Search

None

See application file for complete search history.

(56) References Cited

U.S. PATENT DOCUMENTS

| | | | | |
|---|---|---|---|---|
| 5,122,315 | A * | 6/1992 | Darley | B29C 48/92 264/40.1 |
| 5,599,133 | A | 2/1997 | Costello et al. | |
| 5,911,362 | A | 6/1999 | Wood et al. | |

(Continued)

OTHER PUBLICATIONS

Jiang, Yi, "Durability and Retro-Reflectivity of Pavement Marking (Synthesis Study)," 2008, Purdue University Purdue e-Pubs. pp. 4-14.

*Primary Examiner* — Jethro M. Pence

(74) *Attorney, Agent, or Firm* — Snell & Wilmer L.L.P.; Russell T. Manning

(57) ABSTRACT

Systems and methods are provided for use with a thermoplastic road marking system (e.g., paint truck). The systems and methods control an insertion or replenishment rate of unmelted thermoplastic paint feed stock into a thermoplastic melter based, at least in part, on the rate that thermoplastic melt is being applied to a marking surface. By substantially matching the replenishment rate into the thermoplastic melter with the application rate, thermal variance within the thermoplastic melter is reduced, which improves the consistency of marking lines applied to surfaces.

10 Claims, 8 Drawing Sheets

(51) Int. Cl.
*B05B 9/04* (2006.01)
*B05B 12/08* (2006.01)

(56) References Cited

U.S. PATENT DOCUMENTS

| | | | | |
|---|---|---|---|---|
| 6,439,473 | B1 | 8/2002 | Meyer et al. | |
| 6,729,706 | B1 | 5/2004 | Patton et al. | |
| 6,913,417 | B2 | 7/2005 | Lind et al. | |
| 7,957,841 | B2 | 6/2011 | Zarowny et al. | |
| 8,880,362 | B2 | 11/2014 | Wilkens et al. | |
| 2003/0157262 | A1 | 8/2003 | Cebola | |
| 2003/0177978 | A1 | 9/2003 | Nobutoh et al. | |
| 2004/0099212 | A1* | 5/2004 | Dirienzo | E01C 23/20 118/108 |
| 2005/0081783 | A1* | 4/2005 | Hong | E01C 23/22 118/207 |
| 2005/0127088 | A1 | 6/2005 | Gardos | |
| 2008/0271674 | A1 | 11/2008 | Rademacher et al. | |
| 2008/0300727 | A1 | 12/2008 | Zarowny et al. | |
| 2012/0012684 | A1 | 1/2012 | Mansheim et al. | |
| 2012/0203475 | A1* | 8/2012 | Wilkens | E01C 23/20 702/47 |

* cited by examiner

THERMOPLASTIC PAINT MARKING SYSTEM AND METHOD

CROSS REFERENCE

This application claims the benefit of the filing date of U.S. Provisional Application No. 62/457,860 having a filing date of Feb. 11, 2017, the entire contents of which are incorporated herein by reference.

FIELD

The present disclosure relates to pavement marking. More particularly, the disclosure relates to improved delivery of thermoplastic paint feed stock to a melter or kettle based at least in part on the application rate of thermoplastic paint to a road surface.

BACKGROUND

It is well known that roadways, runways, and other types of surfaces need to have lines or intermittent stripes painted on them to guide traffic, airplanes, etc. A pavement marking material (e.g., paint) is used to create visible stripe paint line. Glass beads may be applied to the freshly painted surface immediately after the pavement marking material is applied. Alternatively, in some applications, the beads may be mixed with the paint. The glass beads serve to make the stripes or lines more visible because they reflect light, such as from a vehicle's headlights. In some applications, the pavement marking material or paint is a thermoplastic product that must be melted prior to application to, for example, a road surface. Thermoplastic road marking paint, also called hot melt marking paint, begins in a solid form. A hot melt kettle is used to heat the solid feedstock to ~200° C. (~400° F.), after which the 'melt' is sprayed on the road surface.

Typically, a flatbed truck is configured to carry all the necessary supplies and equipment (e.g., tanks, kettle/furnace) so that pavement marking material can be applied to the road surface in an economical fashion. A truck used to apply pavement marking materials and beads, referred to herein as a paint truck, has one or more pavement marking material tanks and one or more bead tanks. In operation, paint trucks may travel as fast as 25 mph while painting continuous or intermittent paint lines on the road surface.

For thermoplastic paints, "spray," "extrusion," and "ribbon gun" systems may be used for paint application. In these systems the thermoplastic starts out in a solid form, which is heated past its melting point using a furnace mounted on the truck. In alternate arrangements, a separate pumper truck may provide pre-melted materials to a tank of the paint truck. Once the thermoplastic is a liquid material (i.e., melt), the thermoplastic melt is ready for application to a surface. In a spray system, the thermoplastic melt is pumped using a high pressure pump, which pushes the material through a small opening/orifice at the paint gun. This creates a line on the roadway. In the extrusion system, the thermoplastic melt is pumped at a lower pressure and gathers in a collection box disposed by the road surface. The box opens when material is desired and small, flat stream of material is placed on the ground as the vehicle moves forward. The ribbon gun method is similar to extrusion system with the exception of the box used to gather material by the road surface. A ribbon gun places material directly on the roadway after passing through a flat opening as wide as the desired line.

In any application system, there is usually a specific amount of paint and, if utilized, beads an operator is required to apply per foot to meet various specifications (e.g., state highway requirements). For example, such a specification may require that a 300 lineal feet of a 4 inch wide paint line utilize a gallon of paint and 6 lbs. of beads. Stated otherwise, the paint line has a required 'mil thickness'. Accordingly, it is desirable to monitor the amount of material applied in order to comply with mil thickness specifications and/or to avoid over application (e.g., waste) of such materials.

SUMMARY

The presented disclosure is based on various realizations of the inventors that prior art thermoplastic paint marking systems suffer from various deficiencies. For instance, 50 lb bags of thermoplastic feed stock were previously loaded into kettles or melters' on a paint truck in a single batch. The melter thus had to heat the entire 50 lb bag of feed stock to about 400° F. prior to beginning paint application. Such a heating process takes a significant amount of time and in most cases required a pre-melter to be installed on the truck to speed up the process. After heating the initial batch of feed stock, an operator on the truck loads additional feed stock by hand. That is, the operator loads bags of material directly into the melter. Typically, such operators struggle to keep up with the process and the insertion of feed stock is not consistent. This results in varying consistency (e.g., viscosity) of the melt within the melter. That is, insertion of, for example, 50 lbs of new feed stock reduces the heat of the remaining melt in the melter thereby thickening the same. Such thermal variation likewise causes difficulties in applying a paint line having a consistent mil thickness.

Aspects of the disclosure are further based on a realizations by the inventors that particulated thermoplastic feed stock (e.g., powder, pelletized, etc.) is available and such feed stock has better melting characteristics (e.g., increased surface area) compared to prior materials. The inventors have yet further recognized that the consistency of the melt within the melter/kettle could be improved through use of such material. More specifically, if the feed stock is inserted at a rate substantially equal to the rate that the feedstock exits the melter, thermal variation can be significantly reduced or eliminated improving applied paint/line thickness control. Further, such controlled insertion allows for use of smaller melters/furnaces allowing a paint truck to carry more material. Further, the furnace can operate at a more constant rate.

Systems and methods (i.e., utilities) are provided for controlling the insertion rate/feed of a thermoplastic paint feed stock into a melter/kettle based, in part, on the rate that thermoplastic melt is being applied. Along these lines, the utilities may incorporate one or more sensors for real time or near-real time monitoring of melt/paint usage. In one arrangement, the utility monitors melt/paint usage by continually measuring the flow of individual paint guns and/or the output flow of the melter/kettle. Such a utilities may include flow meters located in each individual supply line of each individual spray gun and/or a main output flow line of the melter/kettle. These flow meters may generate output signals representative of the volume of paint passing through corresponding supply lines. In another arrangement, a pressure based monitoring system is utilized with known paint gun nozzle orifices, box openings, etc., to calculate flow rates. In a yet further arrangement, a head pressure based monitoring system is utilized to determine a flow rate exiting the melter and/or the volume of material in the melter. In any arrangement, the utility utilizes a microprocessor that is programmed to receive the output signals from the sensors to calculate the volume, weight, mass and/or rate of paint/melt being applied to a surface by the spay gun(s) and/or exiting the melter (e.g., application rate).

The application rate of the paint/melt to a surface is equal to the removal rate of the melt leaving the melter. Accordingly, this application rate is equal to a desired replenishment rate or dispensing rate for introducing feed stock into the melter. In the present aspect, a hopper or other storage device (here after 'hopper') holds a bulk amount of feed stock for insertion into the melter/kettle. The hopper includes a controllable dispenser for dispensing the feed stock. In one arrangement, the dispenser includes an auger that displaces the feed stock. However, other controllable dispensers, including without limitation, conveyors and gravity flow systems may be utilized. In operation, the dispenser is controlled to dispense feed stock into a melter at a replenishment rate or dispensing rate that substantially matches the removal rate from the melter. The matching of the removal rate/application rate and the replenishment rate/dispensing rate may occur over a time period/window. By way of example, where the controllable dispenser is an auger, a rotational speed of the auger may be controlled to provide the desired replenishment rate/dispensing rate. Control of the auger rotation rate, in theory, provides a controlled rate of material movement, (e.g., known auger size, auger speed, pellet size, etc.). In practice, movement of granular or pelletized material is non-uniform. For instance, such material can void at the entry of an auger resulting in a reduced transfer rate. Other dispensers may likewise have non-uniform dispensing rates. Accordingly, the present utility further controls the dispenser by a rate of weight change. In such an arrangement, a weight monitoring system includes one or more load cells under the hopper that measure the weight of the hopper and the feed stock material therein (e.g., paint). The dispensing rate of the feed stock material used is controlled based on a starting weight and an ending weight. The dispenser may then be controlled to replenish the melter with a weight of feed stock that matches, for example, a calculated weight of melt/paint applied. For instance, the microprocessor may control the speed of the auger to match the replenishment rate to the removal rate. Alternatively, the microprocessor may intermittently or periodically operate the dispenser (e.g., every 30 seconds) to match the total volume/weight dispensed by the paint guns/boxes during the previous period.

Identification of replenishment rate of unmelted feed stock into a melter further provide for additional control of a paint marking system. For instance, knowledge of the replenishment rate allows for controlling one or more burners to better control the melting of the feed stock. Further, agitation within the melter may be controlled based the identified replenishment rate.

The details of one or more embodiments of the present disclosure are set forth in the accompanying drawings and the description below. Other features, objects, and advantages of the present disclosure will be apparent from the description and drawings, and from the claims.

BRIEF DESCRIPTION OF THE DRAWINGS

For a more complete understanding of the present disclosure and further advantages thereof, reference is now made to the following detailed description taken in conjunction with the drawings

DETAILED DESCRIPTION

Reference will now be made to the accompanying drawings, which at least assist in illustrating the various pertinent features of the presented disclosure. The following description is presented for purposes of illustration and description. Furthermore, the description is not intended to limit the disclosed embodiments of the disclosure to the forms disclosed herein. Consequently, variations and modifications commensurate with the following teachings, and skill and knowledge of the relevant art, are within the scope of the presented disclosure.

Figure 1:
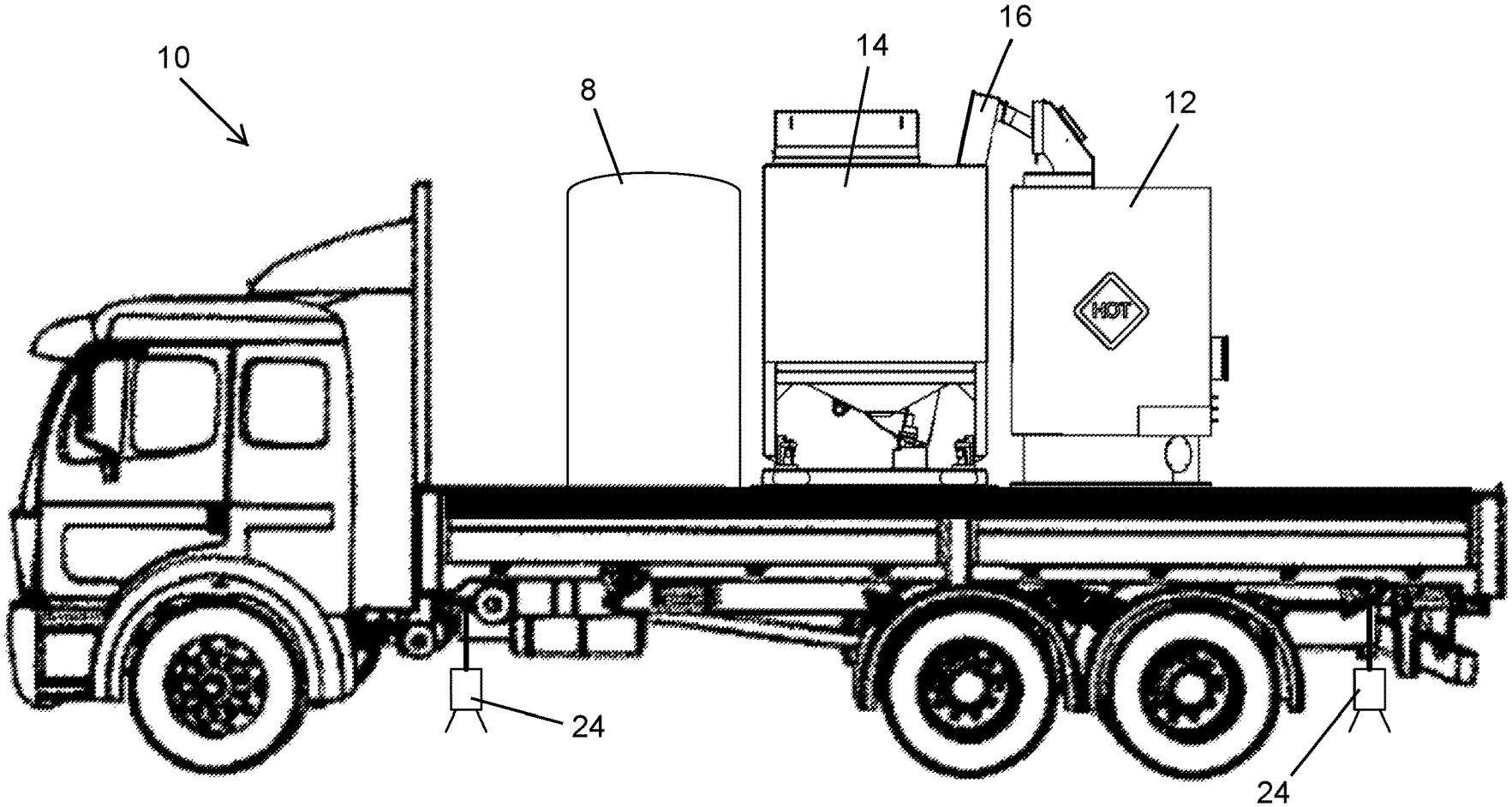
FIG. 1 illustrates a paint truck of a paint marking system.

Referring to FIG. 1, an exemplary embodiment of a paint truck 10 is shown. The illustrated paint truck 10 is adapted for thermoplastic paint application and includes a furnace or melter 12 for melting paint feed stock and a hopper 14 for providing raw (e.g., unmelted) paint feed stock to the melter. The hopper is generally a container with a hollow interior that holds a supply of particulated thermoplastic paint feed stock (e.g., unmelted feedstock). The furnace 12 includes a kettle that is heated by one or more burners (not shown), which are connected to a gas source 8 such as propane. The melter 12 receives the unmelted feed stock from the hopper 14 via a dispenser, which in the illustrated embodiment is an auger 16 that elevates the feedstock from an outlet near the bottom of the hopper 14 to an inlet near the top of the melter 12. Collectively, the hopper/container and dispenser may be termed a dispenser assembly. The melter 12 melts the paint feed stock such that thermoplastic melt or 'paint' at a desired temperature may be supplied to one or more paint guns 24 supported by the truck 10. The depicted truck 10 is presented by way of illustration and not by way of limitation. The truck may be differently configured and may include additional components and/or different arrangements of components. Though shown on a paint truck, it will be further appreciated that the system(s) and method(s) disclosed herein have broader application and may be utilized on walk behind painting units as well as ride-on units. The discussion relating to a paint truck is for purposes of discussion and not by way of limitation.

Figure 2:
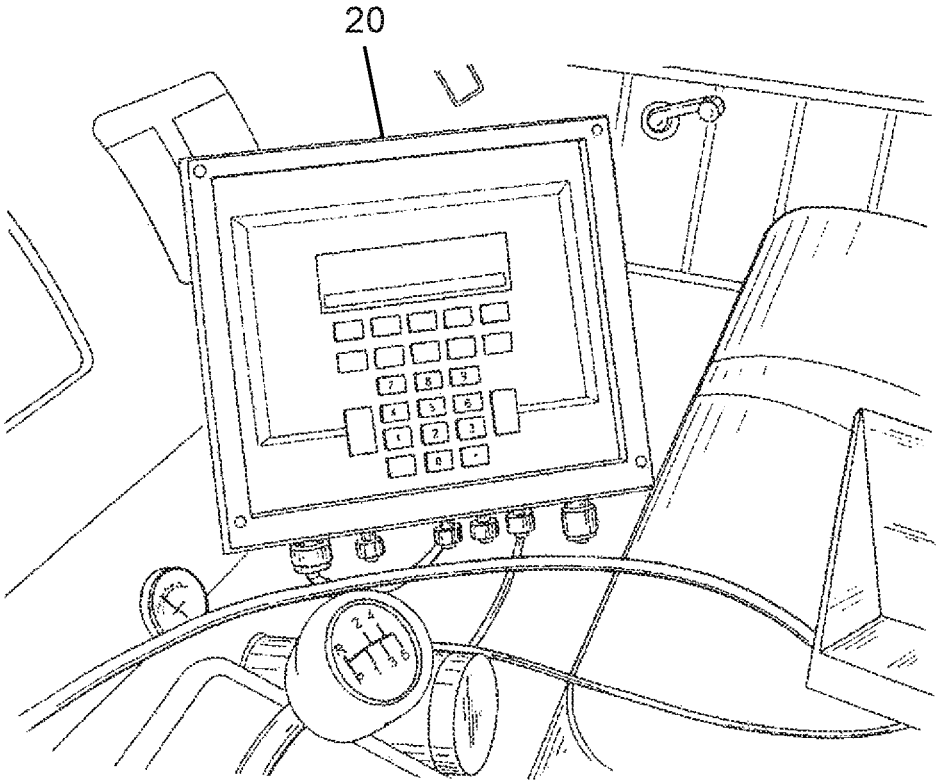
FIG. 2 illustrates a control system of the paint marking system.
Figure 3:
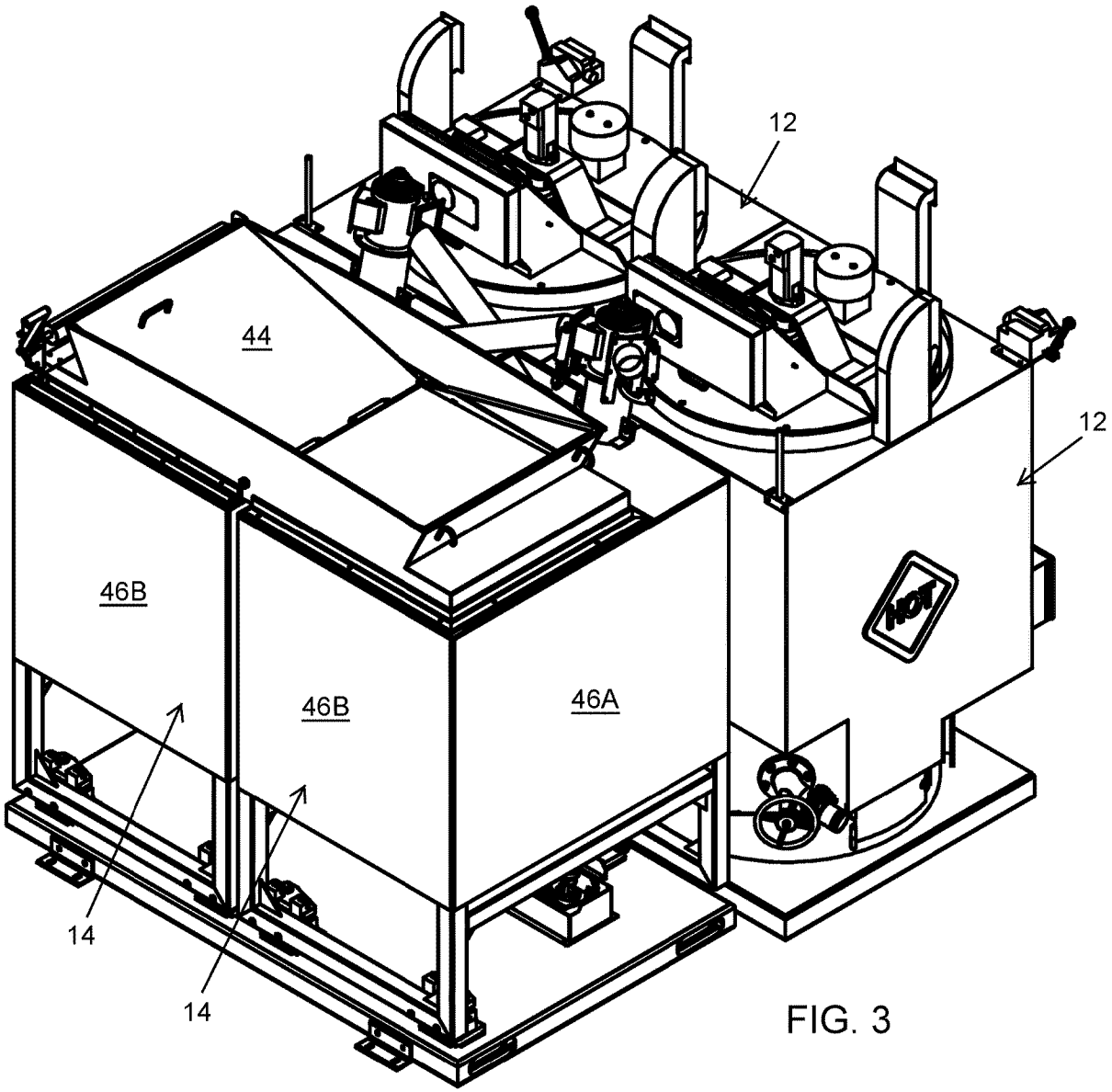
FIG. 3 illustrates a perspective view of a hopper and melter system.
Figure 4:
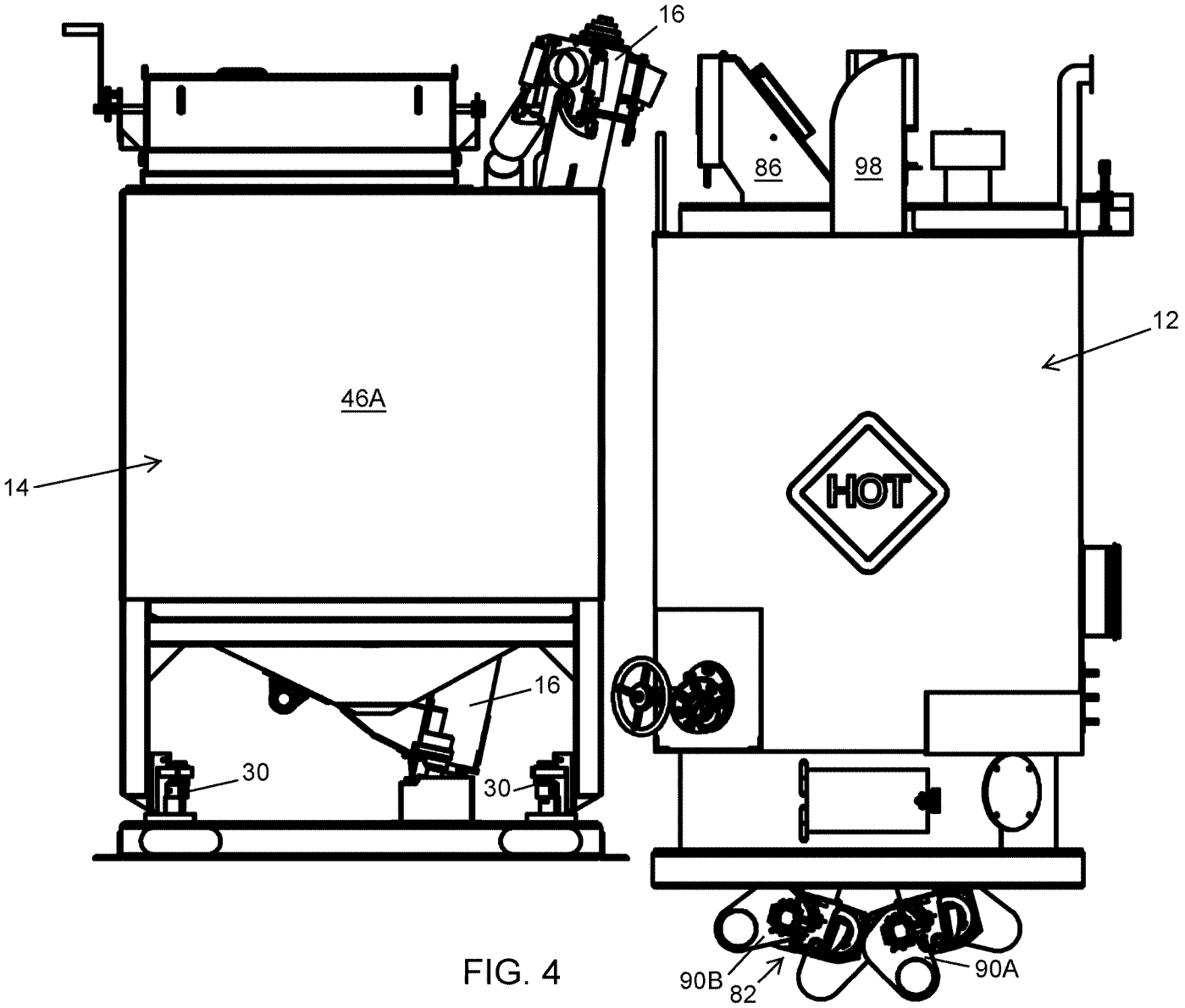
FIG. 4 illustrates a side view of the hopper and melter system.
Figure 5:
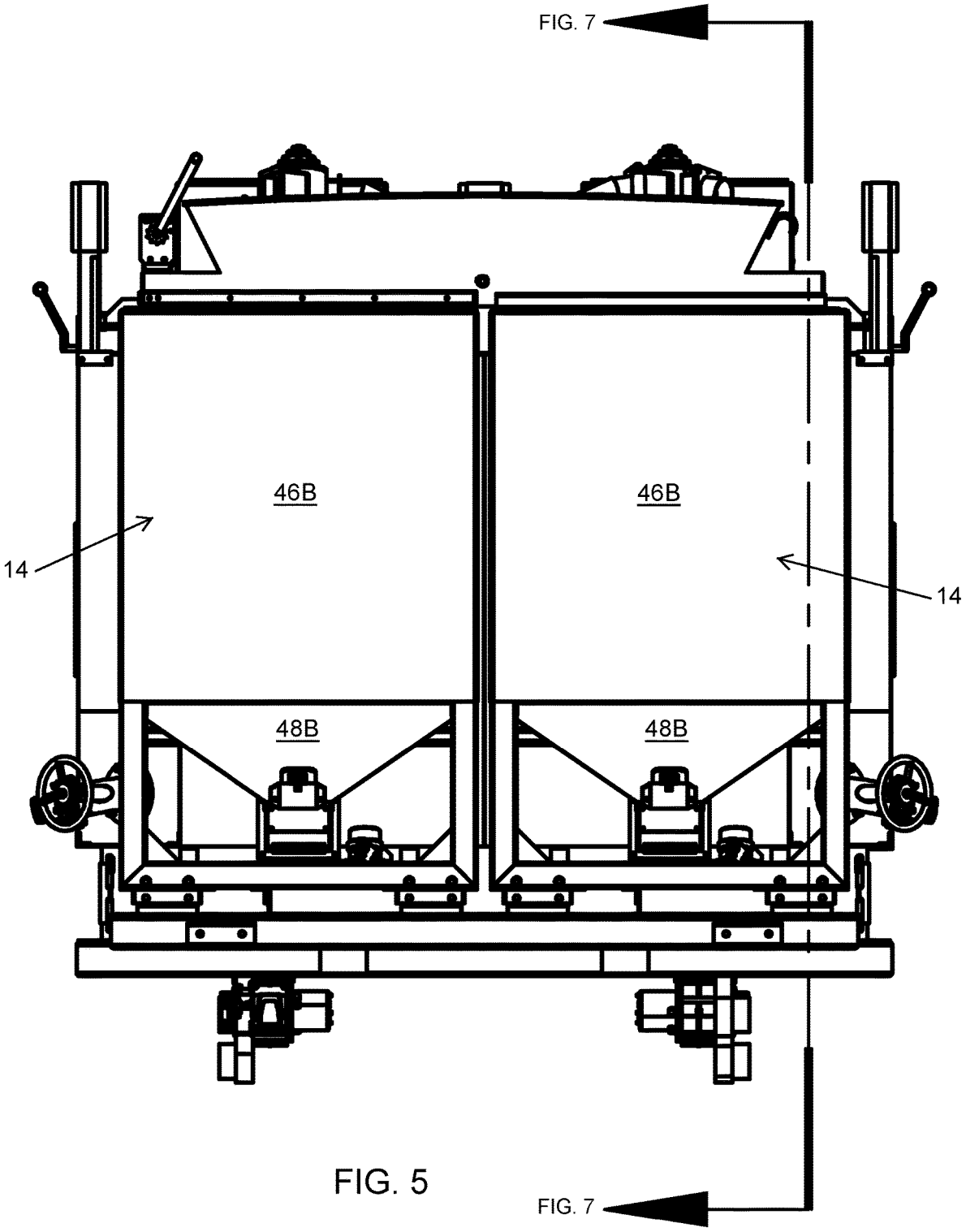
FIG. 5 illustrates an end view of the hopper and melter system.

FIG. 2 depicts a one embodiment of user interface/monitor 20 mounted inside the cab of paint truck 10. Though shown as mounted within the cab of the paint truck, the monitor may be mounted, for example, at an operators control console on bed of the truck. The user interface 20 is programmable and includes a microprocessor that may be instructed to monitor, collect, display and control a variety of desired information and/or alter the operation of the system. In alternate arrangements, the user interface may be or further include a computer (e.g., lap top operatively connected to the system). What is important is that the system includes a processor that is operative to receive and process signals from system components and provides a user interface to receive user inputs.

FIGS. 3, 4, 5, 6 and 7 illustrate perspective, side, end, top and cross-sectional views, respectively, of the melter 12 and hopper 14. As shown in these illustrations, the presented system utilizes a dual hopper and dual melter arrangement. That is, two hoppers 14 and two melters 12 are disposed side-by-side. Such an arrangement is common when applying different colored paints (e.g., white and yellow) to a road surface. However, it will be appreciated that both hoppers may contain the same colored paint. For purposes of discussion, components of both hoppers and both melters will utilize common reference numbers.

As variously illustrated in FIGS. 3-7, the hopper 14 is a suspended a container configured to hold and dispense bulk material such as particulated paint feed stock. Generally, the hollow interior of the hopper 14 tapers downward to funnel material therein to an outlet 42 at or near the lowest point/bottom of the hopper 14. The upper end of the hopper 14 includes a door 44 that may be opened to allow insertion of paint feed stock into the interior of the hopper. In the illustrated embodiment, the hopper 14 is defined by four vertical sidewalls 46A-D (hereafter 46 unless specifically references) and a four angled surfaces 48A-D (hereafter 48 unless specifically referenced) attached to the bottom edges of the sidewalls. The angled surfaces 48 generally form an outlet funnel of the hopper 14. The hopper 14 holds unmelted paint feed stock and allows this feed stock to be directed by gravity to the outlet 42. The outlet 42 of the hopper 14 is connected to the inlet of an auger 16, which lifts feed stock exiting the hopper to an upper inlet of the melter 12, as is more fully discussed herein.

As shown, the hopper 14 is supported above a base 50, which is configured for attachment to a support surface (e.g., truck bed). More specifically, the hopper includes four vertical legs 52A-D (hereafter 52 unless specifically referenced) connected to the corners of hopper sidewalls 46. These legs 52 suspend the hopper 14 above the support surface such that the lower inlet of the auger 16 may be positioned to receive particulated material from the outlet 42 of the hopper 14. Various cross supports may extend between the legs and/or angled surfaces to provide structural support. It will be appreciated that the hopper and/or legs may be made of any appropriate materials. Such materials include, without limitation, carbon steel, stainless steels, and aluminums. The exact configuration of the hopper may be varied based on various factors such as, for example available space, total desired capacity etc. For instance, the hopper may be configured as a generally cylindrical body with a conical funnel attached to the lower end of the cylindrical body.

In the present embodiment, the lower end of each leg 52 of the hopper is supported by a load cell 30A-D (hereafter 30 unless specifically referenced), which connects to the base 50. In the present embodiment, the four legs 52 of the hopper 14 are supported by four load cells 30. The load cells 30 generate output signals indicative of the weight of the hopper 14. Accordingly, as the weight of the hopper 14 is known, the amount of paint feed stock within the hopper 14 can be determined at any time. More importantly, as is further discussed below, the auger 16 may be operated in conjunction with information from the load cells 30 to dispense desired weights, volumes or rates of paint feed stock from the hopper 14 to the melter 12. In one arrangement, the auger 16 operates to replenish feedstock into the melter 12 at a rate that substantially equal to the rate that thermoplastic melt exits the melter 12.

The load cells 30 can be any a transducer creates an electrical signal having a magnitude that is proportional to the force being measured. Various types of load cells include hydraulic load cells, pneumatic load cells, piezo load cells and strain gauge load cells, any of which may be utilized. The electrical signal output is typically in the order of a few millivolts and requires amplification by an instrumentation amplifier before it can be used. The output of the transducer can be scaled to calculate the force applied to the transducer. That is voltage values gathered by the load cell of each hopper are translated into weight readings by a processor, for instance, in the cab of paint truck 10. The microprocessor may generate output to allow an operator to program the system to manipulate the operation of the hopper (e.g., rate of discharge). Further, outputs may be generated that allow an operator to identify volume/weight of thermoplastic melt applied to a marking surface compared to the volume/weight of feedstock supplied to the melter. This may allow manual control of the hopper. However, such control may also be automated.

Figure 7:
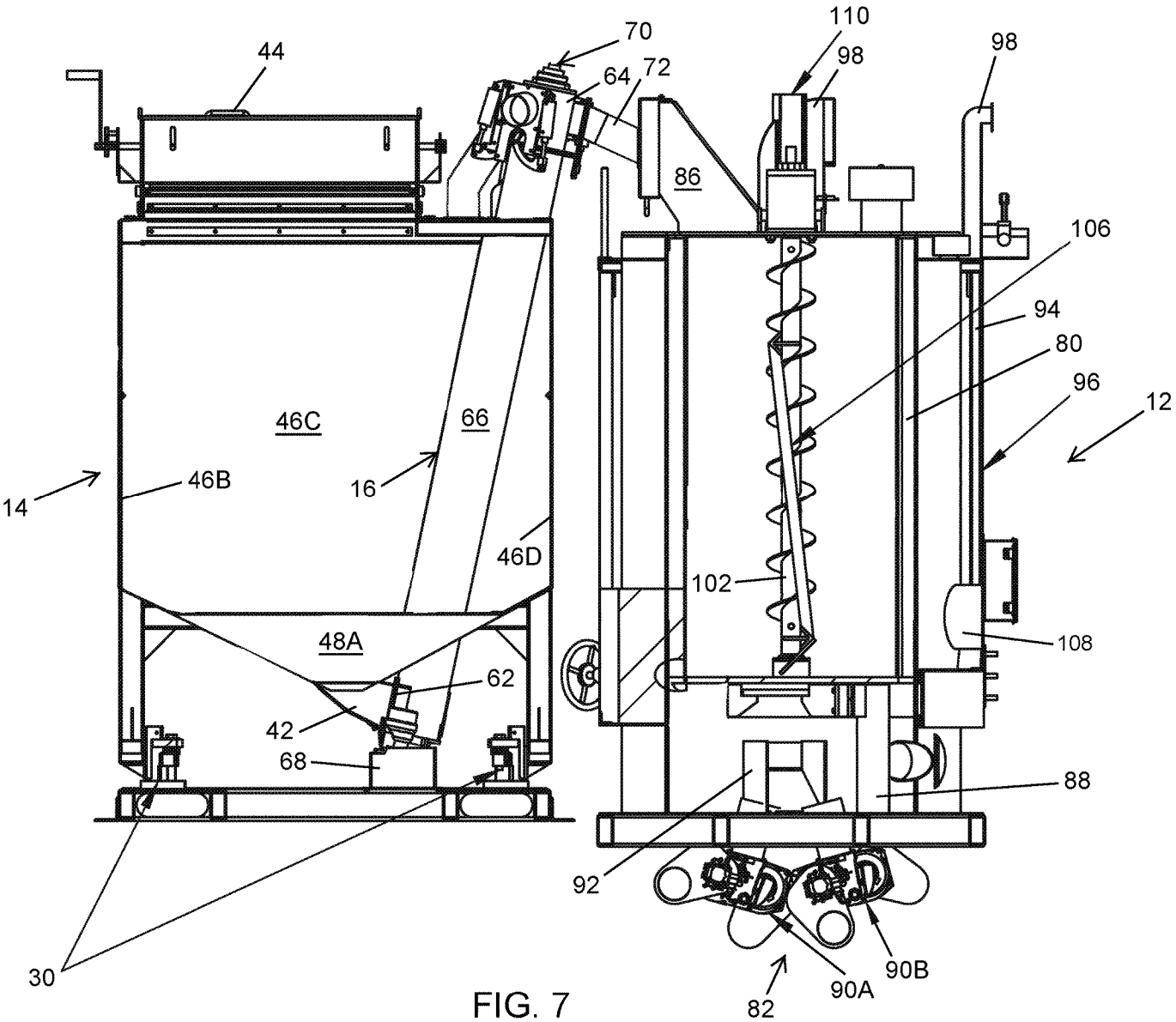
FIG. 7 illustrates a cross-sectional view of the hopper and melter system.

As noted above, the outlet 42 of the hopper 14 feeds into the inlet of a dispenser, which provides the paint feed stock to the melter 12. In the present embodiment, the dispenser is an auger 16. As best illustrated in FIG. 7, an inlet 62 of the auger 62 mates with the outlet 42 of the hopper. The body of the auger 16, in the present embodiment, extends through the interior of the hopper 14 to an outlet end 64 disposed above a top surface of the hopper 14. The extension of the auger 16 through the interior of the hopper 14 minimizes the footprint of the hopper 14. However, it will be appreciated that, in other embodiments, the auger may be external to the hopper 14. As illustrated, the auger has an external cylindrical body 66. The cylindrical body houses a helical screw blade (e.g., "fighting") affixed to a central shaft (not shown) that is substantially similar in configuration to the agitator 84 of the melter 12, which is discussed below. Rotation of the auger lifts particulated feed stock from the inlet 62 of the auger 16 to the outlet end 66 of the auger. As will be appreciated, by controlling the rotation (e.g., RPM) of the auger, the amount (e.g., volume or weight) of feed stock lifted by the augur may be selectively controlled.

To control the rotation of the auger 16, the present embodiment utilizes a variable speed motor 68 connected to the lower end of the auger shaft. An upper end of the auger shaft connects to a bearing assembly 70. Rotation of the auger shaft by the motor 68 lifts particulated feed stock from the outlet of hopper 14 (e.g., inlet end of the auger) to the outlet end 64 of the auger 16.

Figure 6:
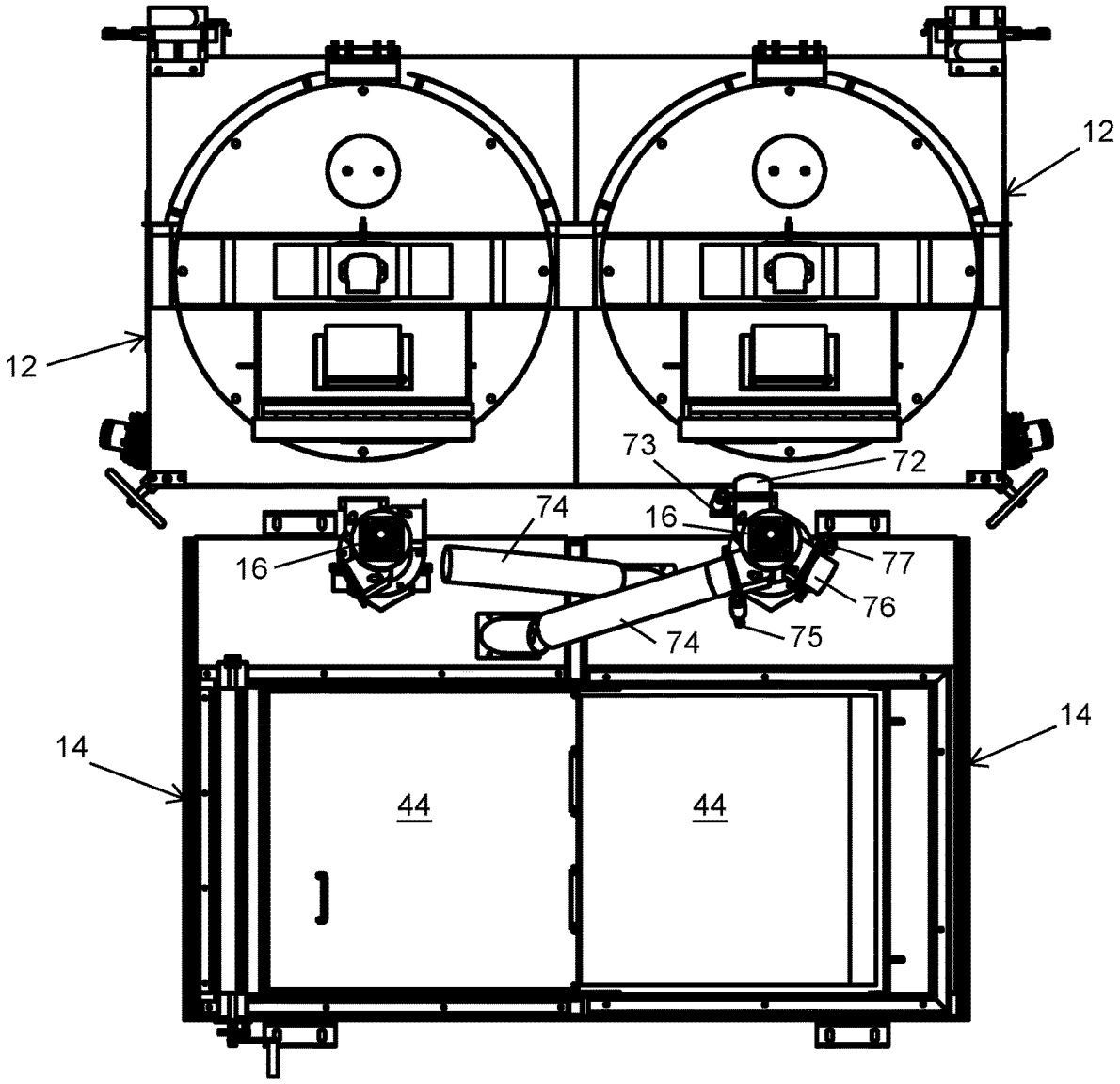
FIG. 6 illustrates a top view of the hopper and melter system.

In the present embodiment, the outlet end of the auger includes various dispatch chutes that may be selectively opened to direct the lifted feed stock to a desired destination. As is best shown by FIGS. 6 and 7, the present embodiment includes three dispatch chutes, a melter chute 72, a transfer chute 74 and an offload chute 76. Each of the chutes is operated by a corresponding actuator 73, 75, 77, respectively. Each actuator is operative to open or close its corresponding chute. The melter chute 72 extends between the outlet end 64 of the auger and an inlet 86 of the melter 12. Accordingly, when the auger 16 is rotating and the melter chute is open, feed stock is transferred from the auger to the melter 12. The transfer chute 74 extends from the outlet end 64 of the auger to the interior of an adjacent hopper (see FIG. 6). This allows transferring feed stock between two hoppers if desired. The offload chute 76 permits emptying the augur 16 when desired. Along these lines, a transfer pipe or other transfer device may be attached to the offload chute 76 to recapture feed stock exiting the offload chute.

The melter 12 includes three primary components, a kettle 80, a burner assembly 82 and the agitator 84. See FIG. 7. The kettle 80 is generally a hollow vessel with an opening in an upper end and a closed bottom end. Paint feed stock enters the interior of the kettle via an inlet chute 86 connected to the melter chute 72 of the auger 16. The burner assembly 80 provides thermal energy to the kettle 80 to melt the feed stock within the kettle and maintain the melted feed stock (i.e., melt) at a desired temperature. The agitator 86 rotates the melt and feed stock within the kettle to facilitate melting and maintaining a uniform temperature throughout the melt. Once the melt achieves a desired temperature, the melt may exit the kettle 80 via an outlet 88 at the bottom of the kettle 80.

In the present embodiment, the burner assembly 82 includes two burners 90A, 90B (hereafter 90 unless specifically referenced). These burners 90 are connected to the gas source 8. In operation the burners 90 burn gas from the gas source to generate heat. The heat from the burners 90 is directed to the bottom of the kettle 80 via a flue 92. This heat contacts the bottom of the kettle 80 and raises around the outside edges of the kettle in an air jacket formed between the vertical outside surface of the kettle 80 and an outer housing 96 of the melter 12. Various vents 98 extend above the top of the melter 12 directing the heated air out of the melter 12. Of note, the use of two or more burners 90 allows for adjusting the amount of heat applied to the kettle. Such adjustment may be based on the insertion rate of feed stock into the burner, as is more fully discussed herein.

The agitator 84 circulates material within the kettle 80 to improve the melting of introduced (e.g., unmelted) feed stock. In the present embodiment, the agitator includes a shaft 102 having a lower end rotably coupled to the bottom of the kettle 80. An upper end of the shaft 102 is rotably connected to the upper end of the melter 12. In the present embodiment, the upper end of the shaft 102 is connected to a variable speed motor 110, which controls the rotation of the shaft. During operation, the agitator 84 moves material within the kettle in two directions simultaneously. More specifically, the agitator 84 moves material in the kettle vertically via rotation of helical fighting 104 attached (e.g., welded) to the shaft 102. The agitator 84 moves material in the kettle horizontally via the rotation of paddles 106 (only one shown) connected to the shaft 102 and/or the fighting 104. Increasing agitator rotation (e.g., RPMs) produces faster and more effective mixing of the unmelted feed stock material with the already melted material (e.g., melt) within the kettle thereby enabling more efficient use of the thermal energy (e.g., BTUs) from the burner(s).

Another component that may be incorporated into the kettle 80 is a head pressure sensor 108. The head pressure sensor is disposed proximate to the bottom of the kettle 80 and generates an output indicative of the pressure within the kettle. As will be appreciated, this pressure corresponds to the volume of material within the kettle. Accordingly, this pressure information may also be utilized to monitor the rate that the feedstock exits the melter. Accordingly, this information may be utilized alone and/or in combination with additional information to control the insertion rate of feed stock into the melter.

Figure 8:
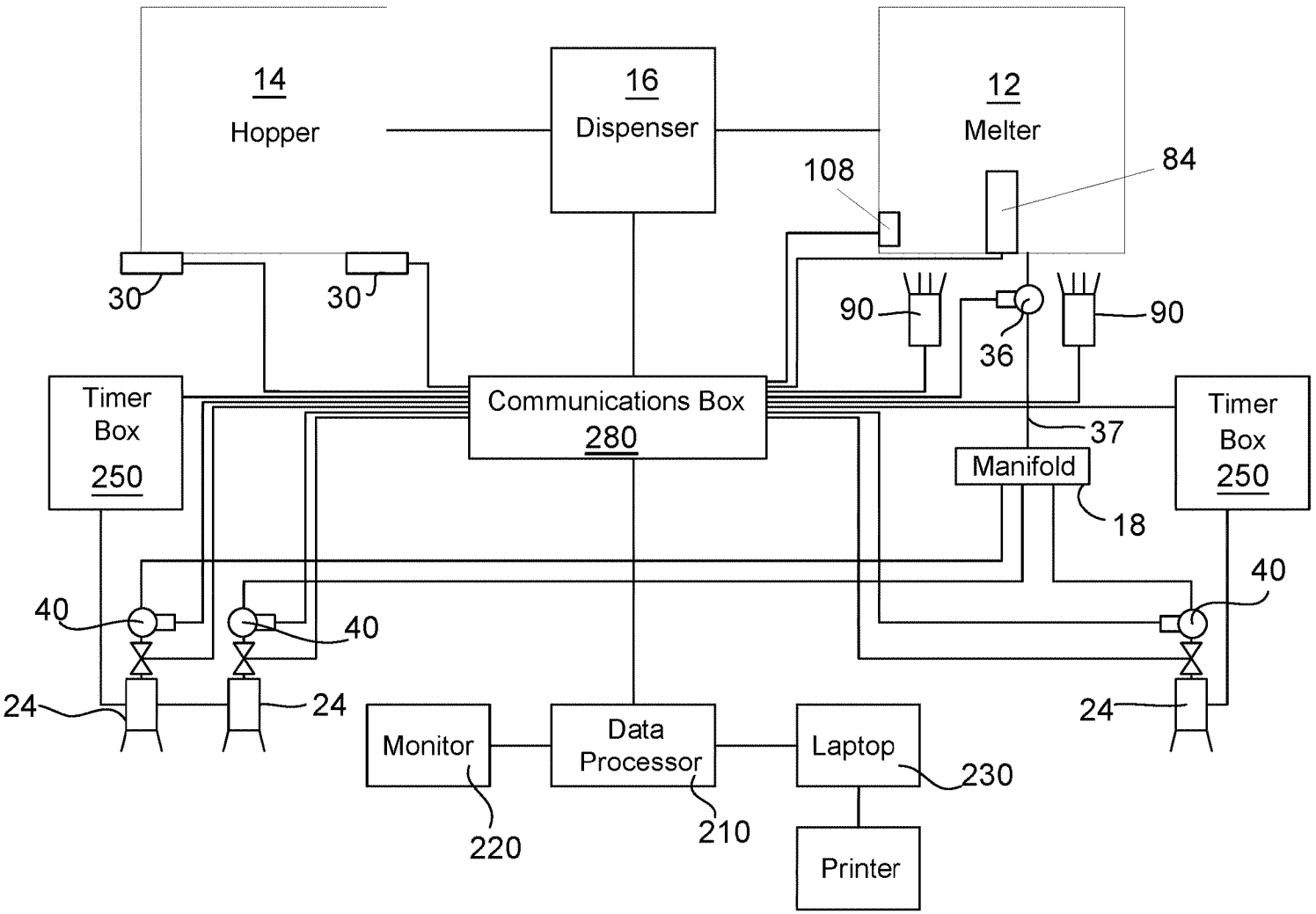
FIG. 8 illustrates a diagram of the paint marking system.

FIG. 8 broadly describes a system that utilizes pressure sensors associated with the paint guns 24 of the paint truck to determine a thermoplastic usage rate. However, it will be appreciated that other use monitoring systems may be utilized and that the following is presented by way of example and not by limitation. In the non-limiting embodiment schematically illustrated in FIG. 8, the system includes a single melter 12 and a single hopper 14. However, it will be appreciated that the system may be scaled to utilize the dual hopper/melter system described above. As shown, the hopper 14 is weighed by one or more load cells 30 that allow for monitoring feedstock usage from the hopper. In one arrangement, a weigh bar is utilized that is fixed at one end and flexes under an applied load. Strain gauges on the bar transform this physical change into voltage values. A suitable weigh bar is available from Weigh-Tronic, Inc., Fairmont, Minn. However, a variety of other load cells may be used to provide an accurate measurement of the weight of the hopper. The use of a weigh bar to monitor usage of beads and, in some instances, paint is set forth in U.S. Pat. No. 6,439,473, the entire contents of which is incorporated by reference herein.

In operation the furnace/melter 14 melt the thermoplastic feedstock such that melt (hereafter paint) flows out from the 12. A pump (not shown) may pressurize this flow and supply the paint through a pressure sensor 36 of a main supply line 37 and into collection manifold 18. The paint then flows from the manifold 18 through one or more secondary supply lines to various paint guns 24 where the paint is applied to the road surface. The number of secondary supply lines and number of paint guns 24 may be varied depending on the exact configuration of a painting system. However, the manifold 18 will typically connect to at least two paint guns 24 (e.g., one or more on either side of the vehicle). Beads may flow out of the bead tank (not shown) through separate supply lines to a series of bead guns (not shown), where the beads are applied to paint applied to a road surface by the paint guns 24. In an alternate embodiment, the paint moves through the main supply line 37 under the force of gravity. That is, in an alternate embodiment the system does not utilize a pump to move the material but rather relies on head pressure (e.g., pressure pot system). The system disclosed herein is functional with both pump operated and gravity fed/pressure pot systems.

One or more pressure sensors (not shown) may be used to monitor the pressure of the paint lines as paint is applied. In various embodiments, the temperature of the material may also be monitored by one or more temperature probes (not shown). Information from such sensors may be used for calibration purposes. However, it will be appreciated in some embodiments, information relating to pressure and/or temperature may be known or inferred and use of such sensors may not be necessary. Likewise, one or more optional pump sensors may monitor pump operation (e.g., rpm). Signals from such sensors, if utilized, are transmitted back to a data/communications box 280. Alternately, such signals may be provided directly to a processor or controller 210, which may be a stand-alone device, incorporated into the monitor 220 and/or a separate computer/laptop 230.

Timer boxes 250 open and close the paint guns. Likewise signals identifying the opening and closing of the guns are transmitted to the communications box 280. The communication box can consist of a PLC or microprocessor and typically incorporates computer readable storage media (not shown). In the illustrated embodiment, the data box 280 transmits signals back to the data processor 210. The processor 210 may be programmed with instructions to cause it to display data on a peripheral device such as a monitor 220 in the truck of the cab, or the screen of a laptop computer 230. The laptop computer 230 can then print data to a printer 240 to generate a written report that contains the data.

Signals from the main line flow meter 36, a vehicle speed from a vehicle speed sensor (not shown) and the timing box 250, as well as signals from any or all of temperature sensors, the pressure sensors, pump sensors, and/or vehicle speed from a vehicle speed sensor (not shown) load cells 30, hopper dispenser 16 (e.g., auger), agitator 84, head pressure sensor 108, and/or burners 90 may be input to the data processor 210. That is, sensor outputs are input to the data box 280 and/or processor 210, which may either comprise a Programmable Logic Controller (PLC) or programmable circuit board.

In order to calculate the volume of fluid flow through a particular paint gun 24 and the resulting mil thickness of a paint line, the processor must have access to various data. Specifically, the size of the supply lines and/or the orifice size of the paint gun may be necessary to effectively calculate flow volume through the spay gun(s) applying paint. That is, flow volumes of the individual guns are dependent at least upon the size of the orifice in the paint gun and/or type of paint gun and different calibration values (e.g., pressures) may be indexed against different gun sizes and/or types. Often, such data is incorporated in look-up tables or calibration curves/equations that allow for determining flow volumes and/or applied mil thickness that is based on one or more variables (e.g., vehicle speed, main line flow volume etc.). Such information may be stored to computer readable storage media. The storage of different calibration information allows user to input necessary information prior to beginning application. Such information may include, without limitation gun type, gun size, material type and/or temperature.

To enhance the flow measurements, the illustrated embodiment incorporates the use of individual spay gun pressure sensors as illustrated in FIG. 8. As shown, each secondary line incorporates an individual pressure sensor 40 (secondary line pressure sensor) proximate to each individual spay gun 24. These pressure sensors 40 are disposed in the flow path of the smaller diameter secondary flow line. Accordingly, these pressure sensors 40 have calibration ranges that are accurate for flow level that are significantly lower than the main line pressure sensor 36. Typically, to provide improved pressure readings, it is desirable to incorporate the pressure sensors 40 into the secondary supply lines at a location as close as possible to the spray guns 24 and/or with as few bends between the meter and the spray gun. The incorporation of the individual pressure sensors allows for improved monitoring of the individual flow volume of each gun. Along these lines, electronic flow outputs of each pressure sensors 40 are output to the communication box 280 and/or the data processor. This allows calculating real-time individual gun flow rates/volumes to a user via the monitor 220 and/or laptop.

The PLC may utilize the information from the various components in any combination to determine how much material (volume and/or weight) is being applied to the road surface for a monitored period. That is, the PLC may determine the application rate of the paint/melt to a surface. As previously noted, this application rate is typically equal the replenishment rate for the melter. Accordingly, this information can be utilized in conjunction with weight measurements from the load cells to control the dispenser 16 (e.g., auger) of the hopper 14 to maintain an inflow of feedstock into the furnaces/melter at a rate (e.g., continuous or periodic) that substantially matches the application rate of the paint. That is, the dispenser may be operated to until corresponding weight of material is introduced into the melter. This may entail monitoring a change in weight of the hopper as identified from outputs of the load cells. This allows determining a replenishment rate or dispensing rate provided by the dispenser. Further, it will be appreciated that the operational speed (e.g., speed of the variable speed motor) of the dispenser may be modified such that the replenishment rate of the dispenser is substantially equal to the identified application rate. For instance, in a paint marking system where two 6 inch lines are simultaneously being applied to a center of a roadway surface, the applicant rate may be significantly higher than an application rate where a single skipped line is applied to the center of a roadway surface. In such an arrangement, if may be desirable or necessary to more rapidly replenish feed stock to the melter. Along these lines, the operational speed of the dispenser may be increased based on the identified application rate. By way of example, where the dispenser is an auger, the rotational speed of the auger may be increased based on an increased application rate. Stated otherwise, a feed or replenishment rate of the dispenser may be increased or decreased to substantially match an application rate of paint material.

The knowledge of the application rate may also permit altering the operation of one or more additional components of the presented paint marking system. For example, during a low application rate marking process, where the insertion/replenishment rate of unmelted feed stock is correspondingly low, sufficient heat may be provided by the operation of a single burner. However, if the application rate increases resulting in a higher replenishment rate, the insertion of a higher volume of unmelted feed stock into the melter may require increasing the fuel burning rate of the burner. Alternatively or additionally, it may be necessary to activate one or more additional burners to maintain desired operating conditions. Likewise, the operation of the agitator may be based on the application rate of the paint to a marking surface. Typically, the rate of agitation may be increased with the application rate of the paint.

In a further arrangement, operation of the dispenser may be controlled, at least in part, based on outputs from the head pressure sensor of the kettle/melter. In the broadest application, outputs of the head pressure sensor may provide the application rate of the paint material to the roadway. In such an arrangement, the dispenser may be controlled based solely on the output of the head pressure sensor to maintain the head pressure in the kettle between a lower and upper threshold. That is, the output of the head pressure sensor may be utilized to maintain a desired level of material within the kettle. In another arrangement, the head pressure sensor outputs are utilized as a backup to for the application rate(s) calculated using the flow rates of the paint guns. That is, over time, the replenishment rate may not exactly equal the application rate. In such instances, the volume of material in the kettle/melter may increase over a desired amount or fall below a desired amount. Accordingly, the operation of the dispenser may be alters (e.g., increased or decreased) to bring the total amount of material in the kettle/melter into a desired range.

The foregoing description of various embodiments of the presented disclosure has been presented for purposes of illustration and description. Furthermore, the description is not intended to limit the embodiments to the forms disclosed herein. Consequently, variations and modifications commensurate with the above teachings, and skill and knowledge of the relevant art, are within the scope of the presented disclosure. The embodiments described hereinabove are further intended to explain best modes known of practicing the disclosed systems and methods and to enable others skilled in the art to utilize the systems and methods in such, or other embodiments and with various modifications required by the particular application(s) or use(s) of the presented systems and methods. It is intended that the appended claims be construed to include alternative embodiments to the extent permitted by the prior art.

What is claimed:

1. A system for applying a pavement marking material to a road surface, comprising:

a hopper having an interior configured to hold a supply of unmelted thermoplastic feedstocks;

a dispenser configured to elevate a portion of the unmelted thermoplastic feedstock disposed within the interior of the hopper to an outlet connectable to a melter chute to controllably dispense the portion of the unmelted thermoplastic feedstock through the melter chute;

at least one load cell disposed between the hopper and a support surface configured to generate a first output indicative of a weight of the supply of the unmelted thermoplastic feed stock in the hopper;

a melter disposed adjacent to the hopper on the support surface and having:

a kettle having a hollow interior with an upper inlet disposed above a bottom surface of the hopper for receiving the unmelted thermoplastic feedstock from the melter chute, and at least a first burner for applying thermal energy to a lower end of the kettle to melt the unmelted thermoplastic feedstock within the hollow interior of the kettle to produce thermoplastic melt;

a paint applicator connected to an outlet in the lower end of the kettle, the paint applicator configured to apply the thermoplastic melt to a marking surface;

at least one sensor configured to generate a second output indicative of an application rate of the thermoplastic melt to the marking surface; and a controller connected to the load cell and the sensor, wherein the controller is operative to:

calculate a rate of weight change of the supply of the unmelted thermoplastic feed stock in the hopper, wherein the rate of weight change corresponds to a dispensing rate of the dispenser; and generate dispenser control signals for receipt by the dispenser to alter the dispensing rate of the dispenser to match the application rate of the thermoplastic melt to the marking surface.

2. The system of claim 1, wherein the controller is further configured to:

generate a burner control signal to alter the operation of the at least one burner based on the application rate.

3. The system of claim 2, wherein the controller is further configured to:

generate a burner control signal to active at least a second burner when the application rate exceeds a predetermined threshold.

4. The system of claim 1, further comprising:

an agitator disposed within the kettle, wherein the controller is configured to generate agitator speed control signals to alter the speed of the agitator.

5. The system of claim 1, wherein the dispenser comprises:

an auger configured to controllably elevate the unmelted thermoplastic feedstock from an interior of the hopper to a location above the hopper.

6. The system of claim 5, further comprising:

a variable speed motor connected to the augur, wherein the variable speed motor receives the dispenser control signals from the controller to alter a rotational speed of the auger.

7. The system of claim 1, wherein the sensor configured to generate a second output indicative of an application rate of the thermoplastic melt to the marking surface comprises:

a head pressure sensor disposed within the kettle, wherein the head pressure sensor generates an output indicative of a volume of material within the kettle.

8. The system of claim 1, wherein the controller is configured to:

generate dispenser control signals to control the dispensing rate of the dispenser to maintain a level of material within the kettle between a lower threshold and an upper threshold.

9. The system of claim 1, wherein the sensor configured to generate a second output indicative of an application rate of the thermoplastic melt to the marking surface comprises:

at least one pressure sensor associated with a supply line between the kettle and the paint applicator, wherein the controller calculates application rate of the thermoplastic melt based on a pressure output of the pressure sensor and stored information associated with the paint applicator.

10. The system of claim 1, further comprising:

an offload chute, wherein the outlet of the dispenser is connectable to the offload chute to unload the unmelted thermoplastic feedstock disposed within the hopper without the unmelted thermoplastic feedstock passing through the melter.

* * * * *